United States Patent [19]

Musschoot

[11] 4,025,419

[45] May 24, 1977

[54] VIBRATORY SAND RECLAIMING APPARATUS

[75] Inventor: Albert Musschoot, Barrington, Ill.

[73] Assignee: General Kinematics Corporation, Barrington, Ill.

[22] Filed: Aug. 29, 1975

[21] Appl. No.: 609,108

Related U.S. Application Data

[63] Continuation of Ser. No. 488,743, July 15, 1974, abandoned.

[52] U.S. Cl. ..... 209/3; 51/14; 51/163.1; 209/255; 209/326; 209/341; 209/372; 209/373

[51] Int. Cl.[2] ..... B24B 31/06; B24B 31/14; B07B 1/30

[58] Field of Search ..... 51/13, 14, 163; 209/3, 209/255, 257, 259, 326, 329, 331, 341, 370–373

[56] References Cited

UNITED STATES PATENTS

| | | | |
|---|---|---|---|
| 790,572 | 5/1905 | Hickman | 209/259 |
| 3,071,900 | 1/1963 | Balz | 51/163 |
| 3,183,630 | 5/1965 | Wright | 51/163 |
| 3,263,373 | 9/1966 | Abrams et al. | 51/163 |
| 3,341,978 | 9/1967 | Carstens | 51/163 |

*Primary Examiner*—Frank W. Lutter
*Assistant Examiner*—Gregory N. Clements
*Attorney, Agent, or Firm*—Wegner, Stellman, McCord, Wiles & Wood

[57] ABSTRACT

A foundry sand reclaiming apparatus is provided in which lumps of used foundry sand are introduced into a vibrating chamber. The lumps abrade each other to produce discrete particles of reusable foundry sand. As the sand builds up in the chamber, the vibratory action moves the sand to an exit opening from which it is discharged from the vibrating chamber. The vibratory conveying action produced during the sand abrading step may be reversed to cause irreducible particles to move toward and be removed from a discharge outlet.

2 Claims, 3 Drawing Figures

10
24
25
14
B
A
11
26
36
16
32
31
34
15C
15B
30
37
12
15A
13
33
27
28
29
22
21
19
17
18
20

VIBRATORY SAND RECLAIMING APPARATUS

CROSS-REFERENCE

This application is a continuation of my copending application Ser. No. 488,743 filed July 15, 1974, entitled "Vibratory Sand Reclaiming Apparatus", now abandoned.

BACKGROUND OF THE INVENTION

In most foundry operations, hot metal is poured into a mold cavity produced by a pattern. The mold cavity is sometimes produced by compressing sand and clay binders together with water to produce a formable mixture which will retain the shape of the pattern. In other processes, the pattern is surrounded by sand which has been treated with a resin binder, which binder hardens in air within a relatively short period of time. Occasionally metal cores and metal rods are used to reinforce the mold, such rods and cores being embedded in the sand at appropriate places.

Because of the increased costs of the sand and other materials used in forming a mold, and because of the cost of disposing of such materials if they are considered scrap, the foundry industry has been faced with the problem of reclaiming sand for reuse in molding operations. The practice heretofore has been simply to place the sand, after the casting has been removed, onto a vibratory screen or other screening apparatus provided with horizontal decks, through which the sand particles pass for reuse. In such processes, only a portion of the sand is recovered for reuse and a good deal still results as waste or scrap material.

BRIEF SUMMARY OF THE INVENTION

After the casting operation has been completed and the casting withdrawn from the mold, the latter comprises lumps of sand cemented together with binders or other cementitious material as well as embedded rods, cores, and the like. If two of the lumps are rubbed together, they are mutually abrasive and discrete particles of sand will be removed from each of the lumps. If such rubbing is continued, the lump is substantially entirely reduced to particulate form and all embedded rods, cores, and the like are released from the sand.

The present invention provides a chamber mounted for vibratory movement and provided with a floor which slants upwardly toward an exit. Lumps of sand directly from the mold are introduced into the chamber and the latter is vibrated causing the lumps to rub together, thereby producing particulate sand as well as freeing any included material. A sand bed is built up in the bottom of the chamber and as its volume increases, such increased volume together with the vibratory movement moves the particulate sand upwardly toward a discharge opening through which the particulate sand may pass for reuse.

DETAILED DESCRIPTION OF THE PREFERRED EMBODIMENT

Figure 1:
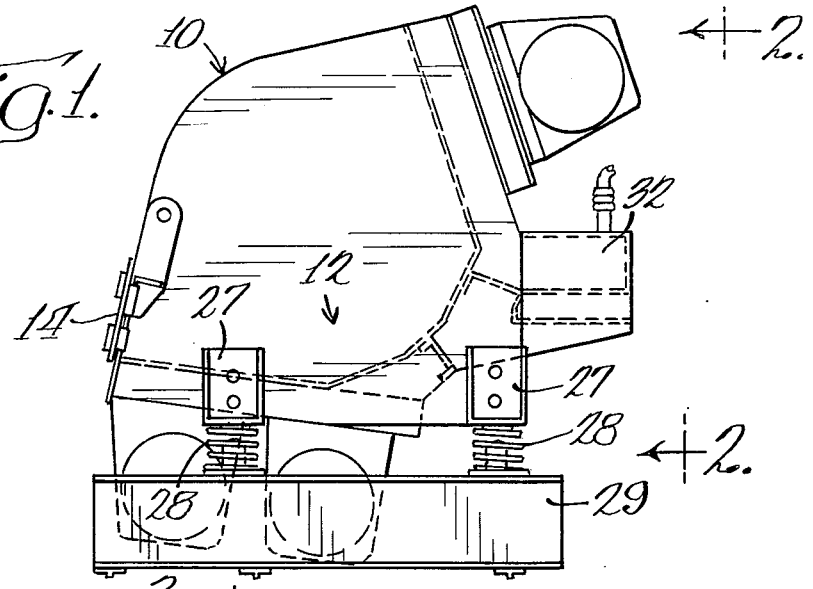
FIG. 1 is a side elevational view showing a vibratory sand reclaiming apparatus in accordance with the present invention.
Figure 2:
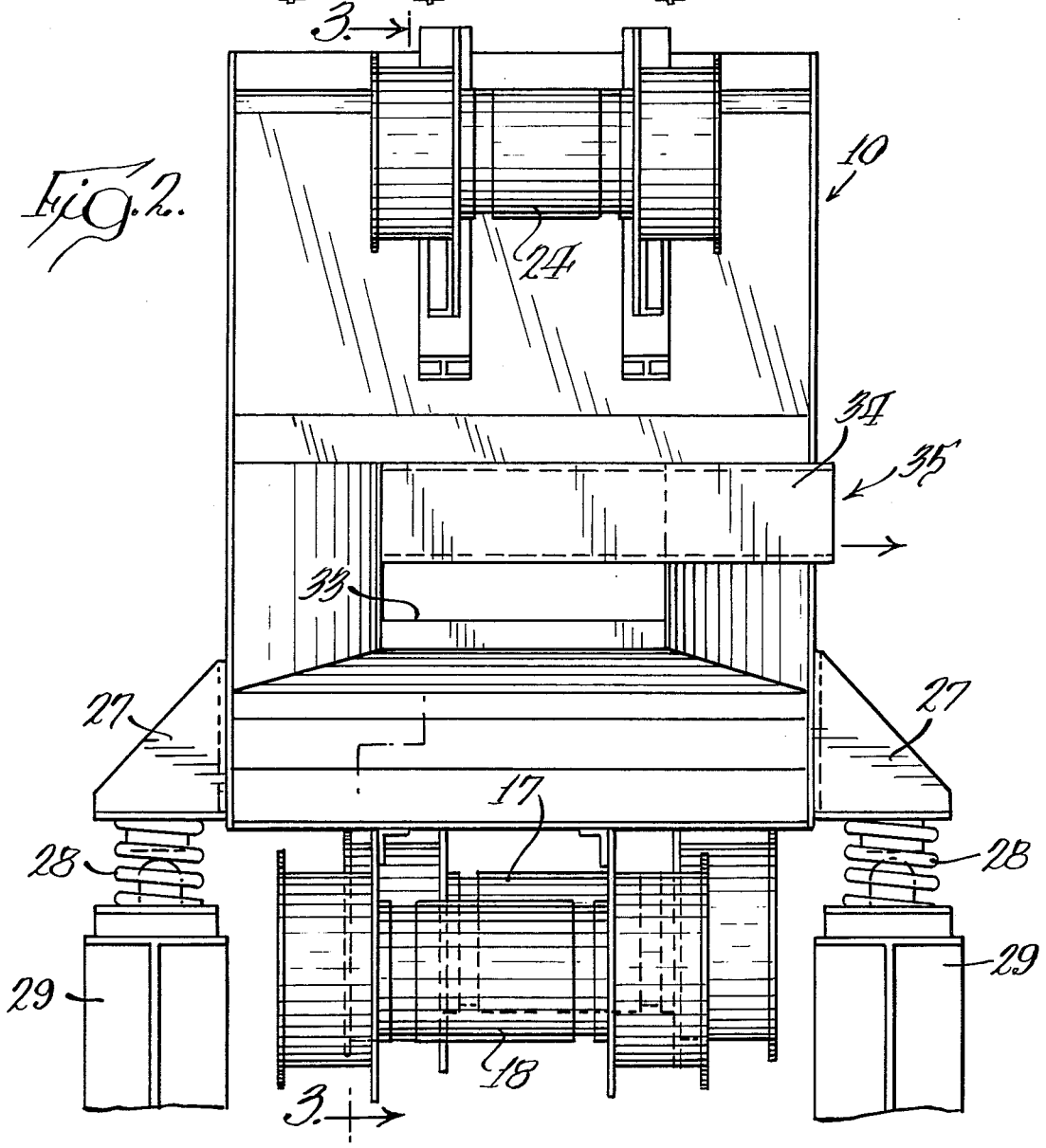
FIG. 2 is an enlarged end view taken from the position indicated by 2—2 of FIG. 1.

Referring now to the drawings, there is shown a closed housing 10 having a chamber 11 therein. In the bottom of the chamber there is a floor 12 having a first portion 13 lslanting downwardly from an entrance into the chamber. The entrance can be closed by means of a door 14 hingedly secured to the housing 10. The floor is provided with a second portion 15A slanting upwardly from the first portion and third and fourth portions 15B and 15C slanting upwardly with increased steepness from the portion 15A. Adjacent the upper end of the floor portion 15C is an exit or discharge opening 16 in the form of an elongated slot in the walls of the housing 10.

Secured to the underside of the housing 10 is a pair of electric motors 17 and 18 provided with shafts 19 and 20, respectively, with each shaft carrying a pair of eccentric weights at each end, the weights at one end being shown at 21 and 22.

The housing also carries a third electric motor 24 positioned near the upper portion of the housing with the motor having a shaft 25 carrying eccentric weights at each end, one of which is shown at 26.

The housing 10 is mounted for vibratory movement by means of brackets 27 secured thereto, which are supported on isolation springs 28, in turn carried by base members 29.

A shelf 30 is secured to the housing 10 subjacent the exit slot 16, the shelf slanting downwardly and opening onto a screen 31 located in a small chamber 32 secured to the right-hand portion of the housing 10. Below the screen 31 and within the chamber 32 is a floor 33. At the end of the screen 31 is a wall 34 which serves to direct material unable to pass through the screen 31 to a side opening 35. The chamber 32 is open at the end of the floor 33 to permit particles falling thereon to pass directly out of the chamber. A flexible pipe 36 is secured to a source of suction for the purposes hereinafter stated.

Figure 3:
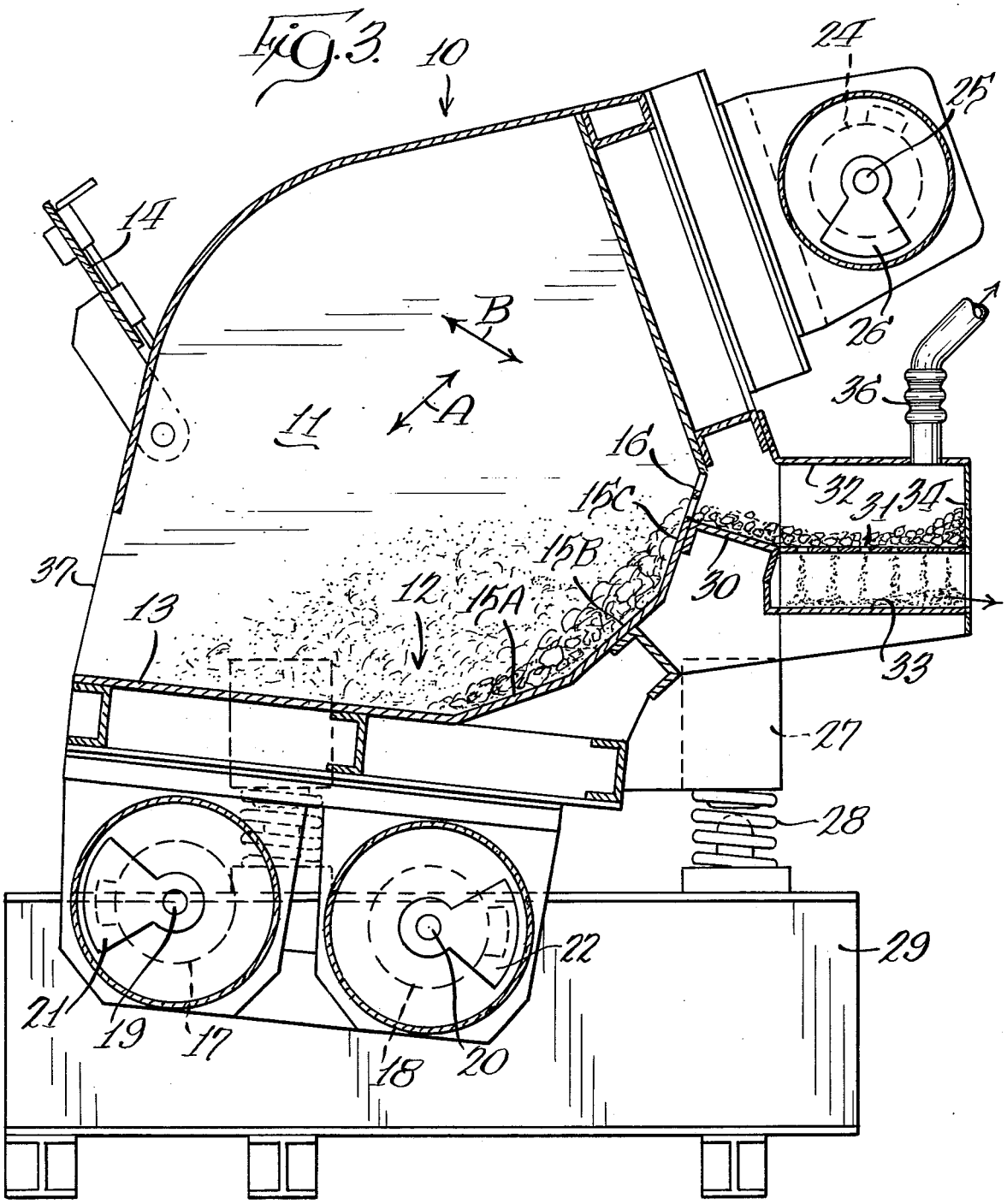
FIG. 3 is a vertical sectional view taken along line 3—3 of FIG. 2.

In operation, the sand lumps and any included material coming from a mold into which a casting has been poured, are introduced into the chamber 11 through the entrance 37 and the gate 14 is thereupon closed. Electric motors 17 and 18 are then started to impart a vibratory movement to the housing and the lumps in the chamber 11 are rubbed against one another to remove sand in the form of discrete particles therefrom. The sand so removed builds up as a body of sand in the bottom of the chamber and its accumulation, together with the vibratory movement which has a conveying action to the right as seen in FIG. 3, will move the discrete sand particles up to the discharge exit 16. Inasmuch as the operation of the electric motors 17 and 18 causes the housing to vibrate back and forth along the line indicated by the double-ended arrow A, material discharged through the exit 16 will be moved down the shelf 30 and onto the screen 31 and will continue to be conveyed toward the right-hand end of the screen. Discrete sand particles will fall through the screen onto the floor 33 which is also vibrated in a conveying action to cause the sand dropping thereon to be moved into a suitable receptacle. Lumps of sand and other included material too large to pass through the screen 31 will be moved to the right-hand end of the chamber 32 into contact with the wall 34. Thus, such materials have a tendency to build up against the wall 34, resulting in further abrading action of the sand lumps unable to pass through the screen so that, in effect, the chamber 32 acts as a secondary recovery chamber to recover additional sand. Particles which will not further abrade, and included metal rods, etc., will be directed by the wall 34 out of the discharge exit 35 to be deposited in a second receptacle.

Dust, for example from the resin binder or clay, is removed from the chamber by means of the suction pipe 36.

After some period of use there will be an accumulation of material in the bottom of the chamber 12, for example metal rods, cores, and large irreducible lumps of sand. To remove this material from the chamber, either the motor 17 or the motor 18 is stopped and motor 24 is started. The operation of these two motors will cause the housing to vibrate back and forth along the line shown by the double-ended arrow B and thus the material on the floor 12 will be conveyed to the left and out of the opening 37.

The apparatus shown and described is a modification and readaptation of the apparatus shown in my U.S. Pat. No. 3, 793,780 which, as shown in that patent, is primarily designed to receive the castings themselves and remove the sand therefrom. The apparatus thus shown has been modified as hereinabove described in order to provide a sand recovery system capable of reclaiming a very substantial portion of sand used in casting processes.

I claim:

1. Apparatus for reclaiming foundry sand from lumps of previously used foundry sand comprising, means forming a closed chamber, a floor in the chamber having a portion slanting upwardly from the horizontal, an exit from the chamber at the upper end of the slanting portion of the floor, an entrance to the chamber to permit the introduction of lumps of sand thereinto, means supporting the chamber for vibratory movement, means for vibrating the chamber along a line inclined to the horizontal to convey material in the chamber toward said exit and to agitate the lumps and cause them to abrade adjacent lumps to remove discrete particles of sand therefrom, said discrete particles of sand accumulating on the floor and increasing in volume as vibration continues until the volume is sufficient to reach the level of the exit, means for modifying the vibrating of the chamber to cause the chamber to vibrate along a line inclined from the horizontal and extending oppositely to said first line to convey materials on the floor toward said entrance, a screen carried by the chamber forming means exteriorly thereof and positioned to receive sand and other material discharged from the exit, a material supporting floor below the screen and carried by the chamber forming means, said screen permitting discrete particles of sand to pass therethrough onto the material supporting floor while prohibiting the passage of larger particles, and means for directing said larger particles to one area and for delivering the sand particles to another area.

2. Apparatus for reclaiming foundry sand from lumps of previously used foundry sand comprising, means forming a closed primary lump disintegrating chamber, a floor in the chamber having a portion slanting upwardly from the horizontal, an exit from the chamber at the upper end of the slanting portion of the floor, an entrance to the chamber to permit the introduction of lumps of sand thereinto, means supporting the chamber for vibratory movement, means for vibrating the chamber along a line inclined to the horizontal to convey material in the chamber toward said exit and to agitate the lumps and cause them to abrade adjacent lumps to remove discrete particles of sand therefrom, said discrete particles of sand accumulating on the floor and increasing in volume as vibration continues until the volume is sufficient to reach the level of the exit, a screen carried by the chamber forming means exteriorly thereof and having one end adjacent the exit and positioned to receive sand and other material discharged from the exit, a material supporting floor below the screen and carried by the chamber forming means, said screen permitting discrete particles of sand to pass therethrough onto the material supporting floor while prohibiting the passage of larger particles, means forming a secondary lump disintegrating chamber including a wall at the other end of the screen extending at right angles to the direction of movement of particles across the screen from said one end of the screen to said other end thereof , said wall serving to retard and obstruct said larger particles by retaining them against the wall for further abrasive action and removal of discrete particles, and means including said wall for directing larger particles from the secondary lump disintegrating chamber to one area and for delivering the sand particles to another area.

* * * * *